US005967963A

United States Patent [19]

Götting

[11] Patent Number: 5,967,963

[45] Date of Patent: Oct. 19, 1999

[54] APPARATUS FOR FOLDING PAPER SHEETS

[75] Inventor: Georg Götting, Lörrach, Germany

[73] Assignee: Grapha-Holding AG, Hergiswil, Switzerland

[21] Appl. No.: 08/971,803

[22] Filed: Nov. 17, 1997

[30] Foreign Application Priority Data

Nov. 26, 1996 [CH] Switzerland ..... 2910/96

[51] Int. Cl.[6] ..... B31F 1/00

[52] U.S. Cl. ..... 493/420; 493/417; 493/476

[58] Field of Search ..... 493/3, 29, 23, 493/30, 416, 417, 405, 419, 420, 421

[56] References Cited

U.S. PATENT DOCUMENTS

| | | | |
|---|---|---|---|
| 3,698,705 | 10/1972 | Funk | 493/420 |
| 3,795,394 | 3/1974 | Walker . | |
| 4,900,391 | 2/1990 | Mandel et al. | 156/364 |
| 4,969,862 | 11/1990 | Ehlscheid . | |
| 5,037,364 | 8/1991 | Whittenberger | 493/420 |
| 5,044,617 | 9/1991 | Roberts | 493/420 |
| 5,047,003 | 9/1991 | Schmidlin | 493/419 |
| 5,054,757 | 10/1991 | Martin | 493/420 |
| 5,158,524 | 10/1992 | Muto | 493/417 |
| 5,183,246 | 2/1993 | Edwards | 493/420 |
| 5,196,083 | 3/1993 | Baker | 493/420 |
| 5,246,415 | 9/1993 | Fuss | 493/420 |
| 5,364,332 | 11/1994 | Gray, Jr. | 493/23 |
| 5,437,597 | 8/1995 | Boughton | 493/420 |
| 5,441,244 | 8/1995 | Bartoes | 493/420 |
| 5,541,066 | 7/1996 | Monaco | 493/420 |
| 5,551,939 | 9/1996 | Deckers | 493/419 |
| 5,564,684 | 10/1996 | Salancy | 493/420 |
| 5,628,718 | 5/1997 | Huober | 493/417 |
| 5,683,338 | 11/1997 | Krasuski | 493/420 |
| 5,769,774 | 6/1998 | Beck | 493/419 |

FOREIGN PATENT DOCUMENTS

| | | | |
|---|---|---|---|
| 0 447 173 | 9/1991 | European Pat. Off. | B65H 29/00 |
| 0 511 574 | 11/1992 | European Pat. Off. | B65H 45/14 |
| 0 640 549 | 3/1995 | European Pat. Off. | B65H 45/12 |

*Primary Examiner*—John Sipos
*Assistant Examiner*—Steven Jensen
*Attorney, Agent, or Firm*—Darby & Darby

[57] ABSTRACT

The apparatus has a driven pair of feed rolls (10, 11) and a folding roll (23) which is urged against the lower feed roll (10). The roll pair (10, 11) transports the sheet into a guide element (35, 36) for guiding and arresting the front end of the sheet. The guide element (35, 36) can be another roll pair with a reversible drive (41). After the front end of the sheet has come to a stop, the sheet is transported into the feed nip (22) between the rolls (10, 23), then folded and discharged downwardly. For increasing the operating speed without damaging the sheets, the roll pair (10, 11) is initially accelerated after the sheet is captured, and subsequently decelerated before the front end of the sheet comes to a stop.

8 Claims, 3 Drawing Sheets

APPARATUS FOR FOLDING PAPER SHEETS

BACKGROUND OF THE INVENTION

1. Field of the Invention

The present invention relates to a folding apparatus. An apparatus of this type is known in the art. In a conventional apparatus of this type, a pair of feed rolls rotates with constant velocity and transports the individually fed sheets into an upwardly inclined buckle chute having a stop. When the front end of the sheet makes contact with the stop, the sheet buckles downwardly against the feed nip between the bottom feed roll and a folding roll. At that point the sheet is captured and folded and discharged downwardly.

SUMMARY OF THE INVENTION

It is the object of the present invention to improve an apparatus of this type so that a higher operating speed can be attained. This object is solved by the apparatus for folding paper sheets, comprising a first feed roll driven by a first drive, a second feed roll urged against the first feed roll, a guide element for guiding and arresting a front end of a sheet, and a folding roll urged against the first feed roll, characterized in that the first drive is constructed and controlled in such a way that after capturing the front end of the sheet, the circumferential velocity (v) of the feed rolls is initially accelerated to a value greater than the feed velocity ($v_0$) of the sheets and is subsequently decelerated, before the front end of the sheet comes to a stop, to a value smaller than the feed velocity ($v_0$).

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1A:
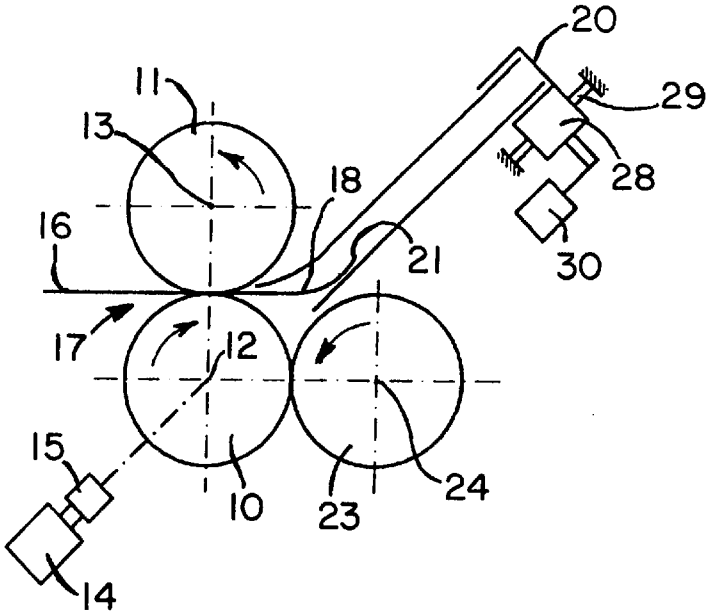
FIGS. 1*a* to 1*c* are schematic illustrations of a first embodiment.
Figure 1B:
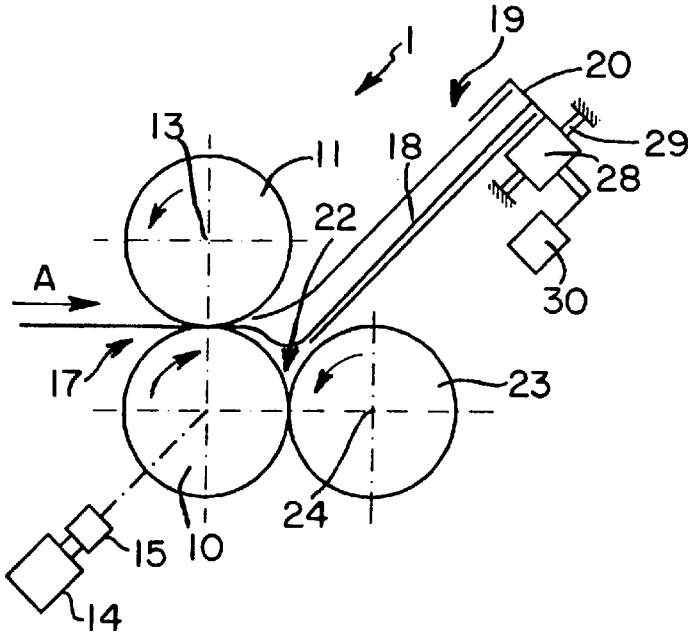
Figure 1C:
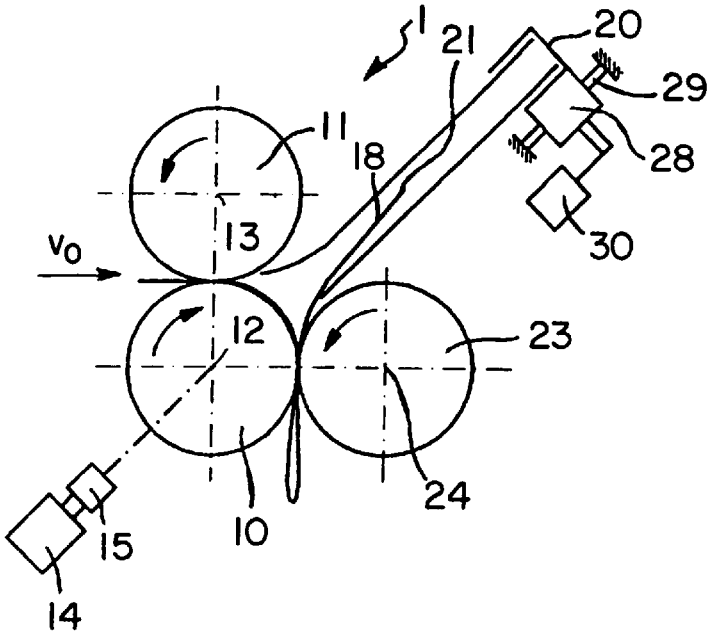

The apparatus 1 according to FIG. 1 includes a pair of feed rolls 10, 11 arranged vertically on top of each other, with their axes of rotation 12, 13 extending horizontally. The bottom roll 10 is driven by a servo motor 14 which is coupled to an angle-position transmitter 15. The rolls 10, 11 have a common tangential plane 16 in the feed nip 17 extending horizontally. The roll pair 10, 11 transports the sheet 18 captured in the feed nip 17 into a buckle chute 19 which is inclined with respect to the plane 16 and has an adjustable limit stop 20 for arresting the front edge 21 of the sheet 18. As soon as the front edge 21 makes contact with the stop 20, the sheet buckles downwardly in the region of the rolls 10, 11 (FIG. 1*b*), until the sheet is captured in the feed nip 22 between the roll 10 and a folding roll 23 which is urged against the roll 10. After being folded, the sheet is removed downwardly by the roll pair 10, 23 (FIG. 1*c*). The axis of rotation 24 of the folding roll 23 is aligned parallel with the axes 12, 13 and located at the same elevation as the axis 12. It is possible to feed the sheets 18 in the transport direction A without leaving gaps between the individual sheets. The rolls 10, 11, 23 can be coupled to each other by gear means, for example by a belt drive.

Figure 3:
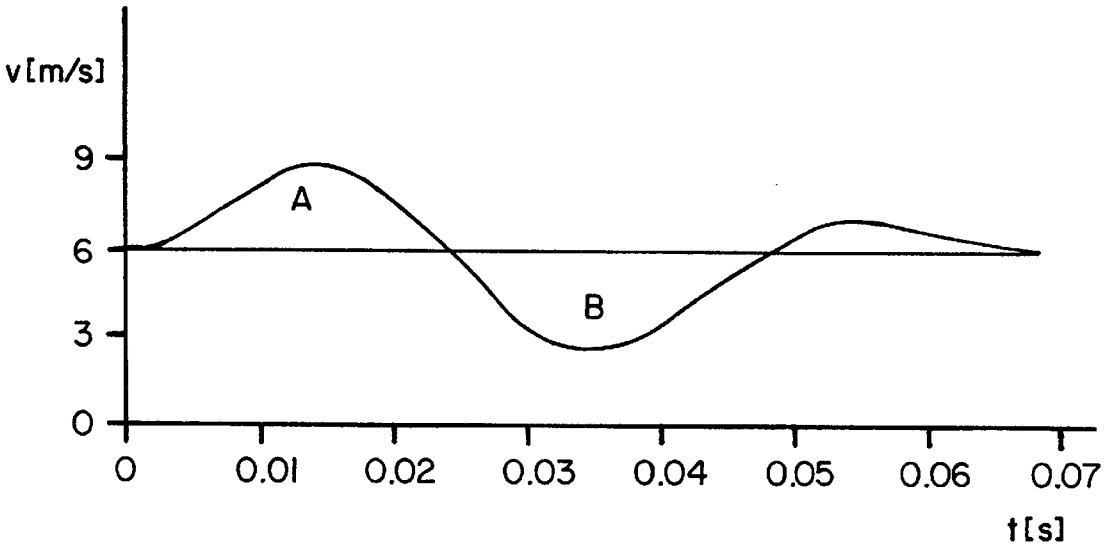
FIGS. 3 and 4 are diagrams of the circumferential velocity of the rolls.

For reducing the impact velocity with the stop 20, the roll 10 and, as a result, also the roll 11 are accelerated as soon as the sheet 18 is captured in the feed nip 17. The rolls 10, 11 are subsequently decelerated, reaching a circumferential velocity which is significantly lower than the feed velocity $v_0$ of the sheets 18. The dependence of the circumferential velocity v of the rolls 10, 11 of an embodiment as a function of time is shown in FIG. 3. In this example, the feed velocity $v_0$ of the paper sheets 18 is 6 m/s. After a sheet 18 is captured in the feed nip 17, the circumferential velocity v is first accelerated to 9 m/s and subsequently decelerated to slightly less than 3 m/s. The front edge 21 makes contact with the stop 20 during the time interval when the velocity is low. Thereafter, the circumferential velocity v is increased to about 7 m/s and subsequently decreased to the feed velocity $v_0$ of the sheets 18. So that the sheets can be fed without leaving a gap therebetween, the area A enclosed by the depicted curve above the feed velocity of 6 m/s must be at least equal in size to the area B enclosed by the depicted curve below the feed velocity of 6 m/s.

With the features of the invention, it is possible to reduce the impact velocity at the stop 20 to a value which is significantly less than the feed velocity $v_0$ of the paper sheets. Consequently, the feed velocity $v_0$ for a given paper quality can be significantly increased. The apparatus can be affixed directly to a printing machine which is not necessarily the case with conventional folding devices due to their low operating speed. With conventional machines, the apparatus is synchronized to the printing machine. With a separately driven apparatus, a light barrier can be located, for example, directly before the feed nip 17 for sensing the front edge 21 of the sheet 18. In this way, synchronization to the feed cycle is quite easy since a gap is formed between consecutive sheets 18 as a result of the acceleration of the sheets 18. The decreased impact velocity also reduces noise. Moreover, the sheets are neither damaged nor creased.

In FIG. 1, there is also depicted an additional apparatus for further reducing the impact velocity at the stop 20. Here, the stop 20 is installed on a carriage which is moveable on a guide 29 parallel to the longitudinal extent of the buckle chute 19. Shortly before making contact with front edge 21, the stop 20 is accelerated in the feed direction A by a servo drive 30 to, for example, half the current angular velocity v of the roll 10. After making contact, the stop 20 is again decelerated and returned to its idle position. The servo drive 30 is controlled, for example, via the rotation angle of the roll 10 which is measured with the angle-position transmitter 15.

Figure 2:
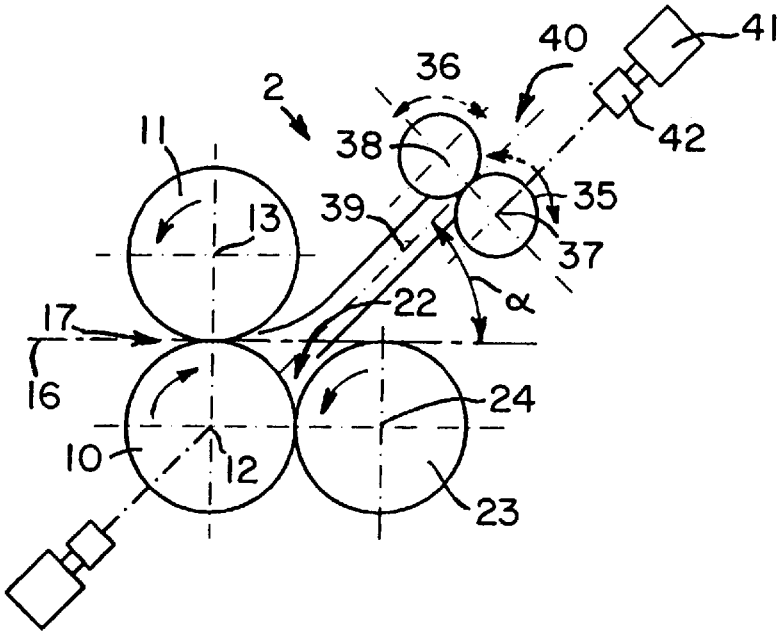
FIG. 2 is a second embodiment.

In FIG. 2 there is depicted another embodiment of the invention. In this apparatus 2, the length of the buckle chute 19 is reduced and the stop 20 is replaced by a pair of rolls 35, 36. The axes 37, 38 of rolls 35, 36 are oriented parallel to the axes 12, 13, 24. The rolls 35, 36 have a common tangential plane 39 in their feed nip 40 which intersects the plane 16 at an acute angle $\alpha$. At least one of the rolls 35, 36 is driven by a servo motor 14 which is coupled to an angle-position transmitter 15. In this embodiment, the rolls 37, 38 initially rotate with the same angular velocity as the rolls 10, 11 until the sheet 18 is captured in the feed nip 40. Subsequently, the rolls 37, 38 are decelerated at the same time when the rolls 10, 11 are decelerated, and brought to a stop at a predetermined adjustable angular position of the roll 10, whereafter they reverse direction. Thereafter, they rotate with the same angular velocity as the rolls 10, 11, 23 but in the opposite direction.

This embodiment is advantageous in that different sheet sizes can be accommodated more easily and that very delicate paper sheets, such as very thin sheets which crumple easily, can also be folded.

Figure 4:
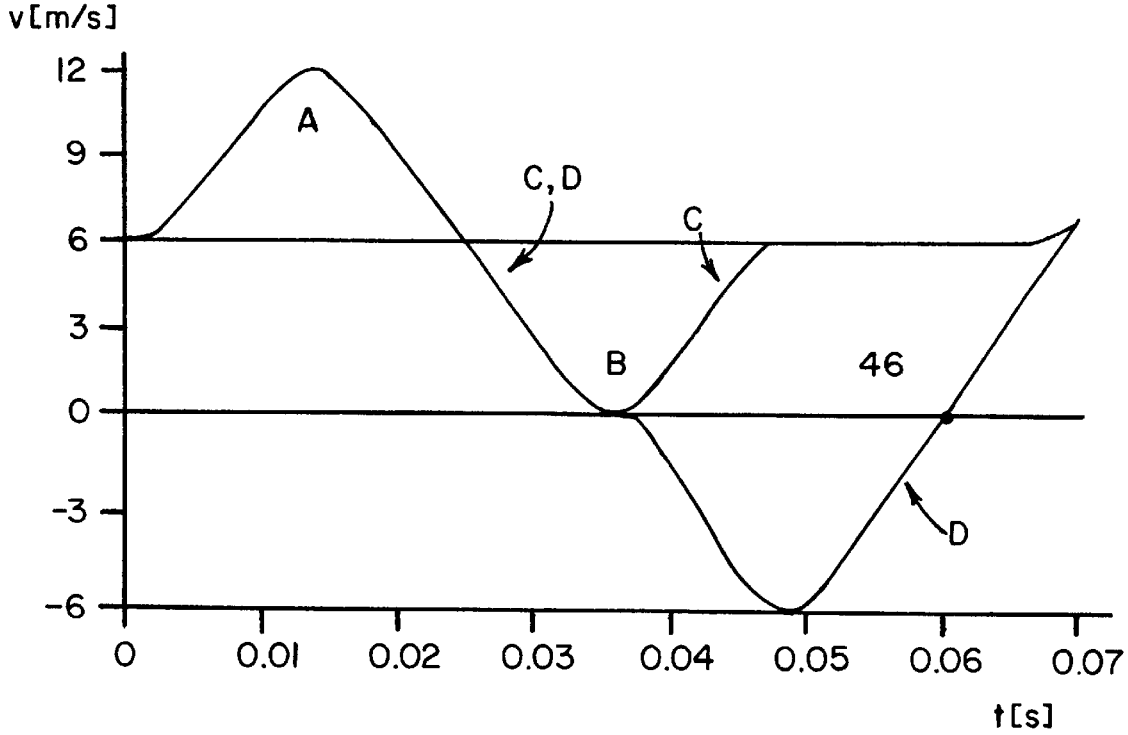

In FIG. 4 there is shown a diagram of the circumferential velocity of the rolls 10, 11, 23 (curve C) as well as of the rolls 35, 36 (curve D). As the diagram shows, after the sheet 18 is fed into the feed nip 17, all rolls 10, 11, 23, 35, 36 are first accelerated from the feed velocity $v_0$ of 6 m/s to a circumferential velocity v of 12 m/s and thereafter decelerated to a complete stop. The rolls 10, 11, 23 are then accelerated again to the initial velocity $v_0$, whereas rolls 35, 36 rotate synchronously with the same velocity, but in the opposite direction. The sheet 18 is synchronously transported by the two roll pairs 10, 11 and 35, 36 into the feed nip 22 and folded. At or shortly before the location 46, the front edge 21 of the sheet 18 exits the rolls 35, 36, whereafter rolls 35, 36 are again decelerated and then accelerated again until they rotate synchronously with the rolls 10, 11, 23 in the original direction. When the next sheet 18 is fed, all rolls 10, 11, 23, 35, 36 rotate again synchronously. The area A must be at least equal in size to the area B so that the sheets 18 can be fed without leaving a gap therebetween.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for folding paper sheets (18), comprising a means for feeding said sheets at a feed velocity ($v_0$);

a first feed roll (10) for receiving said sheets from said feeding means having a circumferential velocity (v) and being driven by a first drive (14);

a second feed roll (11) urged against the first feed roll (10);

at least one guide element (19, 20; 35, 36) for guiding and arresting a front end of a sheet (21), and a folding roll (23) urged against the first feed roll (10);

a means for controlling said first drive (14) such that after capturing the front end of the sheet (21), the circumferential velocity (v) of the first and the second feed roll (10, 11) is initially accelerated to a value greater than the feed velocity ($v_0$) of the sheets (18) and is subsequently decelerated, before the front end of the sheet (21) comes to a stop, to a value smaller than the feed velocity ($v_0$).

2. The apparatus according to claim 1, wherein the guide element comprises a buckle chute (19) with a stop (20).

3. The apparatus according to claim 2, wherein the stop (20) can be adapted to the paper size.

4. The apparatus according to claim 2, wherein the stop (20) can be moved back and forth in the transport direction A of the sheets (18) with the help of an oscillating second drive (30).

5. The apparatus according to claim 1, wherein the guide element comprises two cooperating reversing rolls (35, 36) connected to a reversible third drive (41), and wherein the circumferential velocity (v) and the direction of rotation of said reversing rolls (35, 36) are regulated via a folding cycle (T).

6. The apparatus according to claim 5, wherein a plane (39) tangential to the reversing rolls (35, 36) in an input nip (40) intersects a plane (16) tangential to the first and second feed roll (10, 11) in an input nip (17) at an acute angle $\alpha$.

7. The apparatus according to claim 1, wherein the integral of the positive value of the difference between the circumferential velocity (v) of the first and second feed roll (10, 11) and the feed velocity ($v_0$) of the sheets (18) over time (t) during a cycle time (T) is at least as large as the integral of the negative value (B) of this difference.

8. A printing machine including an apparatus for folding paper sheets (18), comprising a means for feeding said sheets at a feed velocity ($v_0$);

a first feed roll (10) for receiving said sheets from said feeding means having a circumferential velocity (v) and being driven by a first drive (14);

a second feed roll (11) urged against the first feed roll (10);

at least one guide element (19, 20; 35, 36) for guiding and arresting a front end of a sheet (21), and a folding roll (23) urged against the first feed roll (10);

a means for controlling said first drive (14) such that after capturing the front end of the sheet (21), the circumferential velocity (v) of the first and the second feed roll (10, 11) is initially accelerated to a value greater than the feed velocity ($v_0$) of the sheets (18) and is subsequently decelerated, before the front end of the sheet (21) comes to a stop, to a value smaller than the feed velocity ($v_0$).

* * * * *